United States Patent [19]

Simpson et al.

[11] 4,063,346

[45] Dec. 20, 1977

[54] SILVER COLOR PROOF COIN OR MEDAL AND METHOD OF MAKING THE SAME

[75] Inventors: James W. Simpson, Springfield; Andrew Cosgarea, Jr., Newtown Square, both of Pa.; Richard D. Bankert, Wilmington, Del.

[73] Assignee: Franklin Mint Corporation, Franklin Center, Pa.

[21] Appl. No.: 681,863

[22] Filed: Apr. 29, 1976

[51] Int. Cl.[2] ..... B22D 11/126

[52] U.S. Cl. ..... 29/527.7; 204/146; 148/2; 29/DIG. 16; 29/90 R; 40/27.5

[58] Field of Search ..... 29/527.6, 527.7, DIG. 16; 204/146; 156/18, 666, 903

[56] References Cited

U.S. PATENT DOCUMENTS

| | | | |
|---|---|---|---|
| 1,698,486 | 1/1929 | Yungblut | 204/146 X |
| 1,818,379 | 8/1931 | Cain et al. | 204/146 |
| 2,285,308 | 6/1942 | Specht | 29/527.6 X |
| 3,429,751 | 2/1969 | Heuse | 204/146 X |
| 3,533,863 | 10/1970 | Lee et al. | 29/527.7 |

FOREIGN PATENT DOCUMENTS

| | | | |
|---|---|---|---|
| 908,436 | 10/1962 | United Kingdom | 204/146 |

*Primary Examiner*—C.W. Lanham
*Assistant Examiner*—V. K. Rising
*Attorney, Agent, or Firm*—Seidel, Gonda & Goldhammer

[57] ABSTRACT

A silver color coin or medal is produced from a copper-silver alloy containing from about 30 to 60% by weight of silver. The normal rose color caused by the copper in the alloy is removed by selective electrolytic etching.

14 Claims, 1 Drawing Figure

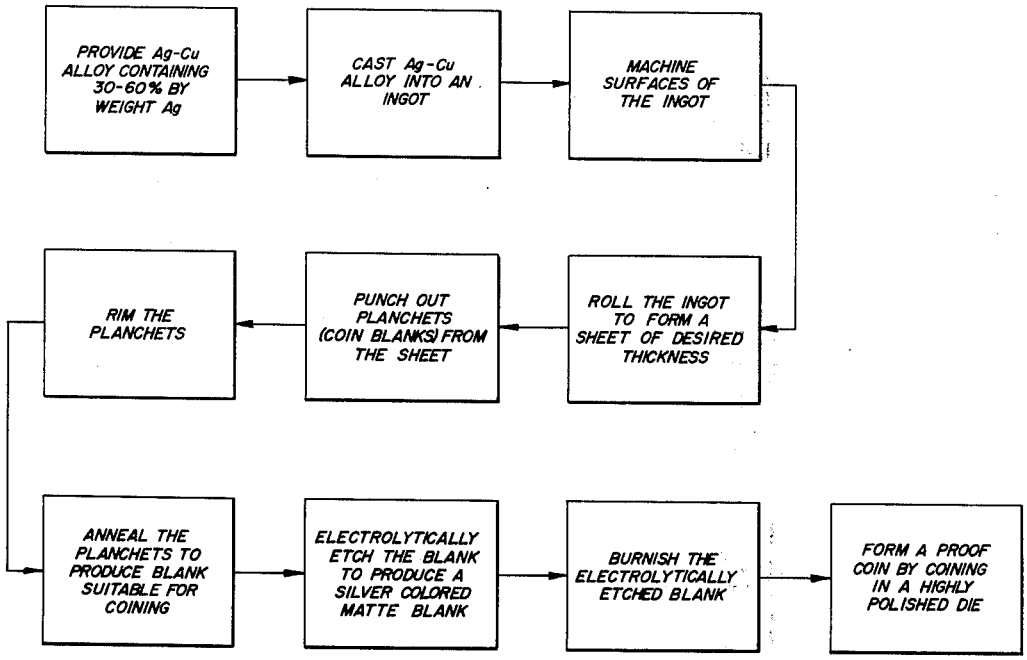

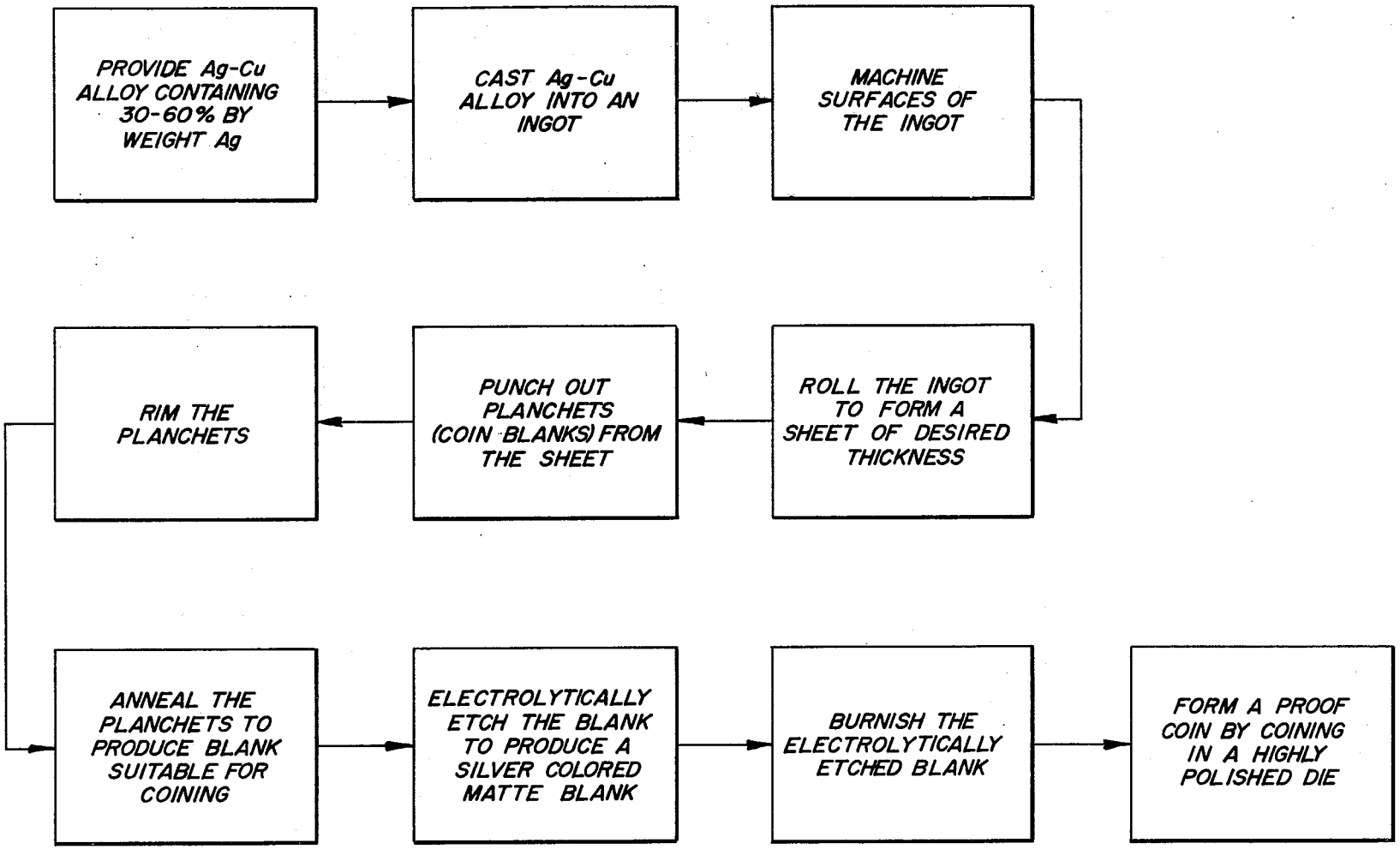
PROVIDE Ag-Cu ALLOY CONTAINING 30-60% BY WEIGHT Ag
CAST Ag-Cu ALLOY INTO AN INGOT
MACHINE SURFACES OF THE INGOT
RIM THE PLANCHETS
PUNCH OUT PLANCHETS (COIN BLANKS) FROM THE SHEET
ROLL THE INGOT TO FORM A SHEET OF DESIRED THICKNESS
ANNEAL THE PLANCHETS TO PRODUCE BLANK SUITABLE FOR COINING
ELECTROLYTICALLY ETCH THE BLANK TO PRODUCE A SILVER COLORED MATTE BLANK
BURNISH THE ELECTROLYTICALLY ETCHED BLANK
FORM A PROOF COIN BY COINING IN A HIGHLY POLISHED DIE

SILVER COLOR PROOF COIN OR MEDAL AND METHOD OF MAKING THE SAME

BACKGROUND OF THE INVENTION

This invention relates to a proof silver color coin or medals made from a copper-silver alloy, having a high copper content, and a method for making the same. Such coins or medals may be used in making commemorative medallions as well as legal tender. As used herein, the term "coin" or "coins" will be understood to include coins, medals, medallions, and other similar metallic art objects.

DESCRIPTION OF THE PRIOR ART

Copper-silver alloys are well known in the art. Previously, legal tender in the United States and other countries has been made of copper-silver alloys. Up until 1965, the United States' silver coinage was made of a silver alloy comprising 90% silver and 10% copper. Present-day "silver" currency comprises sandwich type coins containing no silver, but having copper-nickel alloys on the outside. This is in view of the relative scarcity of silver as well as its increasing uses in other technologies, such as the electronics industry.

This invention pertains to a method of making a silver coin made of a copper-silver alloy in which each component is present in approximately equal percentages. By utilizing the method of the present invention, the coin will have a luster and finish equivalent to that of sterling silver, and may be made with a proof finish.

The Royal Canadian Mint fairly recently has been minting coins made of a copper-silver alloy having approximately equal proportions of copper and silver. To reduce the copper color present in such coins, the Royal Canadian Mint has been subjecting the finished coins or the coin blanks to a chemical etch, for example, chromic acid. The rose-hued coins are placed in this solution for a sufficient time to remove the rose color.

By using such a conventional chemical etching technique, it is impossible to produce a silver coin having a true proof finish. The term "proof" has a specific meaning in the numismatic art, and a coin having a proof finish has the following characteristics: an extremely smooth surface without graininess, high luster, and is evenly reflective.

The coins produced by the Royal Canadian Mint do not have such a proof finish. The chemical etch technique eliminates the copper color from the coin by dissolving the copper from the surface of the coin. However, due to the limited ability to control the speed and extent of the chemical etching process, some of the silver constituent phase at the surface appears to be undermined by etching away too much copper. This creates pits in the face of the coin, which sometimes become quite deep. When deep pores or pits are formed, the silver peaks break off during the coining process, leaving silver particles on the coining dies, which mar the surface of subsequent coins. This marring of the surface is in the form of lines or streaks, referred to as flow marks. In severe cases, the radially extending flow marks may produce a sunburst effect on the coin surface. The best finish which can be produced by using a chemical etch might be called a proof-like finish, characterized by a greater degree of graininess in the surface of the coin as compared to a true proof finish.

SUMMARY OF THE INVENTION

The present invention overcomes the problems associated with chemical etching of a copper-silver alloy coin to eliminate the rosy, copper color. The present invention uses electrolytic etching to eliminate the copper color, while at the same time the surface texture of the coin is not so substantially altered that a proof finish is unattainable. Thus, a proof coin is produced from a copper-silver alloy in which the silver and copper are present in approximately equal proportions, and which has a color equivalent to that of sterling silver coins.

BRIEF DESCRIPTION OF THE DRAWINGS

The single sheet of drawings illustrates a flow diagram of a process according to the present invention for producing a silver color proof coin or medal.

DETAILED DESCRIPTION OF A PREFERRED EMBODIMENT

In producing a silver proof coin from a copper-silver alloy having a reduced silver content, an alloy is chosen having approximately 30 to 60 weight percent, and preferably about 40 to 60 weight percent silver. An alloy with a very low silver content would give a coin having a very porous surface because such a large amount of copper would be removed by the etching step. A good proof coin may be produced by choosing a copper-silver alloy containing about 40 weight percent silver. Below 30% silver, by using an electrolytic etch, good silver color may be obtained but a good proof finish is unobtainable. A cooper-silver alloy containing silver contents higher than 60 weight percent is generally too hard for coining. A copper-silver alloy containing 72% silver is at the eutectic composition and is very brittle and therefore not coinable. The eutectic composition is also slightly yellow. Thus, a significant saving is achieved by producing a proof silver coin having silver color comparable to that of sterling silver, yet having significantly less silver content.

A preferred alloy contains 50% copper and 50% silver. The alloy is then cast into an ingot, the surfaces of which are machined to a relatively smooth finish. The ingot is then rolled into a sheet of the desired thickness and "planchets" or coin blanks are die punched out. The coin blanks are preferably rimmed before annealing to alleviate a directional property which is imparted to the material during rolling.

The coin blanks should be annealed at a temperature approximately 100° F. or less below the melting point of the particular copper-silver alloy. This temperature should be maintained for approximately 40 minutes. This ensures that the planchet will have the proper degree of hardness to be coinable. The proper degree of hardness for both coinability and good wear characteristics is a Rockwell$_B$ hardness of approximately 15–50, and preferably 15–30. For comparison purposes, sterling silver usually has a Rockwell$_B$ hardness of approximately 20. If a planchet has a hardness above Rockwell$_B$ 60, it cannot be coined at all. Also, a planchet having too high a degree of hardness will shorten the life of the coining die.

After the coin blank is formed, it is subject to an electrolytic etching process to remove the copper from the surface, and produce a silver-colored coin capable of acquiring a proof finish. Almost any inert electrolyte is suitable, although sulfuric acid, hydrochloric acid and commercially available fluoborate electrolytes are preferred. In general, the electrolytes used for copper electroplating and copper electropolishing are suitable, except that copper (Cu) in the following formulas would preferably be replaced by sodium ($Na_2$) or the like. Common electroplating solutions include $CuSO_4$-$H_2SO_4$, $Cu(BF_4)_2$-$HBF_4$, and $Cu_2(P_2O_7)$-KOH. Common copper electropolishing solutions include orthophosphoric acid ($H_3PO_4$), pyrophosphoric acid ($H_4P_2O_7$), phosphoric-$CrO_3$ solutions according to U.S. Pat. No. 2,347,939 and modified phosphoric acid solutions according to U.S. Pat. No. 2,366,714. The particular concentration of the acid electrolyte may vary between approximately 10–50% by volume with little difference noted in the resulting coin.

An electric current should be applied at a sufficient potential to remove copper. Thus, the potential should be equal to or greater than the oxidizing potential for copper but preferably less than the oxidizing potential for silver in order that only copper and not silver be dissolved. Normally, in a production operation, voltage is not controlled precisely, therefore it is important to control the rate of electrolytic etching.

The current may have a density of 10–50 amps/ft.$^2$. At the lower end, the copper is dissolved slowly, while at the upper end, in some instances, the copper may dissolve too rapidly, creating pitting and roughness. A current density of 15–20 amps/ft.$^2$ is preferred. Preferably, this current density is maintained for 2 minutes, but the time period may vary from 1 to 10 minutes. The copper is removed from the coin, acting as an anode, at a preferred charge density of 1800–2400 coulomb/ft.$^2$.

As the copper is removed from the coin blank, it is plated onto the cathode. However, after a number of coins are electrolytically stripped of their copper coloring, the copper concentration within the solution begins to build up, due to the lower efficiency at the cathode as compared to the anode, and the electrolyte must be recharged.

After etching and before coining, the coin blank has a matte finish. If a proof finish is to be achieved from the coining, it is necessary that the etched coin blank be burnished to beat down the rough peaks which are left by etching. Burnishing and subsequent coining are carried out according to conventional techniques as described below.

The invention may be more fully understood by reference to the following specific, non-limiting example. It is to be understood that the example is merely for illustration, and it is not for the purpose of limitation.

EXAMPLE

A copper-silver alloy containing 50 weight percent copper and 50 weight percent silver was cast into an ingot. After machining its surfaces, the ingot was rolled into a sheet of approximately 3/32 inch thickness and 1.5 inch diameter planchets were die punched out. The planchets were then rimmed and then annealed at 1375° F. by being placed in a 10 foot heating zone on a conveyor traveling at 3 inches per minute for 40 minutes. This copper-silver alloy melts at 1450° F. The resulting coin blanks were tested and found to have a Rockwell$_B$ hardness of 35–40. The coin blanks were then immersed as anodes in an electrolytic cell having sulphuric acid (50% by volume) as the electrolyte. Current was applied at a current density of 15 to 20 amps/ft.$^2$ for about 2 minutes and at a charge density of 1800–2400 coulomb/ft.$^2$. In coin blanks having a thickness of approximately 3/32 inch and a diameter of 1½ inch, 10 mg of copper was etched from the surface.

After the blanks were etched, they were burnished in the same manner as used with sterling silver blanks, namely being tumbled in a basin containing soap and steel shot approximately 5/32 inch in diameter to peen the surface. With this copper-silver alloy, it was necessary to burnish the coin blanks longer than is usual with sterling silver coins. Burnishing is carried out until substantially all evidence of etching disappears, as determined by examination under a low power microscope. This removes roughness, milkiness or haziness and makes the coin shiny and clean. Coining was done in the normal manner using proof dies, pressing the coin blanks at a pressure of approximately 90–100 ton/inch$^2$. This coining process is the same as used in producing sterling silver coins.

Using the electrolytic etching technique, approximately the same rate of rejects are produced as during the coining of sterling silver coin blanks. As compared with a chemical etching process where flow marks are produced after only a couple of blanks are coined, there were no flow marks after over 2200 coins were coined after using the electrolytic etching process. Electrolytic etching may also lower the reject rate because of elimination of dirt and other foreign matter.

The present invention may be embodied in other specific forms without departing from the spirit or essential attributes thereof and, accordingly, reference should be made to the appended claims, rather than to the foregoing specification as indicating the scope of the invention.

We claim:

1. A method of making a silver color proof coin or medal from a copper-silver alloy comprising the steps of:

a. producing a copper-silver alloy wherein the silver component is from 30 to 60 weight percent of said alloy;
b. forming a coin blank from said alloy;
c. electrolytically etching said coin blank for a sufficient time to remove a sufficient amount of copper from the surfaces of said coin blank to produce a coin blank having a silver surface color;
d. burnishing said electrolytically etched coin blank; and
e. coining said coin blank in a highly polished die.

2. The method of claim 1 wherein said alloy is approximately 50 weight percent copper and 50 weight percent silver.

3. The method of claim 1 wherein said coin blank forming step comprises the substeps of:

1. casting said alloy to form an ingot;
2. machining the surfaces of said ingot;
3. rolling said ingot into a sheet of the desired thickness;
4. blanking said sheet to produce planchets;
5. rimming said planchets; and
6. annealing said rimmed planchets to produce a coin blank of suitable hardness for coining.

4. The method of claim 3 wherein said annealing substep comprises heating said planchets at a temperature which is less than about 100° F. below the melting temperature of said alloy for about 40 minutes to produce a coin blank having a Rockwell$_B$ hardness of about 15–50.

5. The method of claim 1, wherein said electrolytic etching step comprises making said coin blank the anode in an electrolytic cell having an electrolyte concentration of about 10 to 50 percent by volume, applying a current at a current density of from about 10 to about 50 amps/ft.$^2$ for a sufficient time to remove the copper color from the surface of said coin blank.

6. The method of claim 5 wherein said electrolyte is selected from the group consisting of sulfuric acid, hydrochloric acid and fluoborate electrolytes.

7. The method of claim 5 wherein said potential is applied at a current density of from about 15 to about 20 amps/ft.$^2$ for about 2 minutes.

8. A silver color proof coin or medal made according to the method of claim 1.

9. A silver color proof coin or medal made according to the method of claim 2.

10. A silver color proof coin or medal made according to the method of claim 3.

11. A silver color proof coin or medal made according to the method of claim 4.

12. A silver color proof coin or medal made according to the method of claim 5.

13. A silver color proof coin or medal made according to the method of claim 6.

14. A silver color proof coin or medal made according to the method of claim 7.

* * * * *